US008168043B2

(12) United States Patent
Titmas

(10) Patent No.: US 8,168,043 B2
(45) Date of Patent: May 1, 2012

(54) RETORT APPARATUS AND METHOD FOR CONTINUOUSLY PROCESSING LIQUID AND SOLID MIXTURES AND FOR RECOVERING PRODUCTS THEREFROM

(75) Inventor: James Titmas, Stow, OH (US)

(73) Assignee: Eau-Viron Incorporated, Gaylordsville, CT (US)

( * ) Notice: Subject to any disclaimer, the term of this patent is extended or adjusted under 35 U.S.C. 154(b) by 748 days.

(21) Appl. No.: 12/231,152

(22) Filed: Aug. 29, 2008

(65) Prior Publication Data

US 2010/0050466 A1 Mar. 4, 2010

(51) Int. Cl.
*C10B 31/00* (2006.01)
*C10B 53/00* (2006.01)

(52) U.S. Cl. ..... 201/21; 201/25; 201/29; 201/32; 202/100; 202/117; 202/118

(58) Field of Classification Search ..... 202/117, 202/200, 136, 99, 100; 201/25, 33; 110/246; 585/240, 241

See application file for complete search history.

(56) References Cited

U.S. PATENT DOCUMENTS

| | | | | |
|---|---|---|---|---|
| 1,717,786 | A | 6/1929 | Clayton-Kennedy | |
| 4,280,279 | A | 7/1981 | Grundfest | |
| 4,285,773 | A * | 8/1981 | Taciuk | 202/100 |
| 4,308,103 | A * | 12/1981 | Rotter | 202/117 |
| 4,563,246 | A * | 1/1986 | Reed et al. | 202/100 |
| 4,583,468 | A | 4/1986 | Reed et al. | |
| 4,724,777 | A | 2/1988 | Reed et al. | |
| 4,730,564 | A * | 3/1988 | Abboud | 110/246 |
| 5,088,856 | A | 2/1992 | Yocum | 405/128 |
| 5,217,578 | A | 6/1993 | Taciuk et al. | 202/100 |
| 5,523,060 | A * | 6/1996 | Hogan | 422/184.1 |
| 5,820,736 | A * | 10/1998 | Bouziane et al. | 202/136 |
| 6,105,275 | A * | 8/2000 | Aulbaugh et al. | 34/424 |
| 6,213,030 | B1 * | 4/2001 | Robertson et al. | 110/246 |
| 7,416,641 | B2 * | 8/2008 | Denison | 202/99 |

OTHER PUBLICATIONS

PCT International Preliminary Report on Patentability and Written Opinion (dated Mar. 10, 2011—8 pages).

* cited by examiner

*Primary Examiner* — Nina Bhat
(74) *Attorney, Agent, or Firm* — Renner, Kenner, Greive, Bobak, Taylor & Weber

(57) ABSTRACT

A retort apparatus includes a primary rotating pipe within a second rotating pipe within a fixed pipe (27). The interior area of the primary rotating pipe is bounded by a heated pipe. A first annulus is formed between the primary and second rotating pipes. A second annulus is formed between the second rotating pipe and the heated pipe. A third annulus is formed between the primary rotating pipe and the fixed pipe. A heater is positioned within the interior area of said primary rotating pipe. In one embodiment, an inlet gate is provided for introducing a liquid and solid mixture into the first annulus proximate the second end thereof. A first conveyor is provided to move the mixture toward the hot end of the primary rotating pipe. A second conveyance is provided for transferring the mixture from the first annulus to the second annulus within the interior of the primary rotating pipe, and a third conveyance is provided to move the mixture within the second annulus in a direction toward the cooler end of the primary rotating pipe. A method according to the invention includes introducing a liquid and solid mixture into an annulus formed between the two rotating pipes and causing the mixture to move within the annulus toward one end of the pipe. The method also includes transferring the mixture from the annulus to the interior area of the inner rotating pipe, and causing the mixture within the interior area to move in a direction toward the other end of the rotating pipe.

13 Claims, 8 Drawing Sheets

RETORT APPARATUS AND METHOD FOR CONTINUOUSLY PROCESSING LIQUID AND SOLID MIXTURES AND FOR RECOVERING PRODUCTS THEREFROM

TECHNICAL FIELD

This invention relates generally to an apparatus and method for the heating of liquid and solid mixtures in order to remove volatile constituents therefrom. More particularly, the present invention is directed toward the effective recovery and recycling of heat energy from those same liquid and solid mixtures. Specifically, the invention provides for the recovery and recycling of heat energy by controlling and directing the flow of the liquid and solid mixture, as well as various gases, vaporized liquids and combustion products, within the apparatus, and recovering useful by-products therefrom.

BACKGROUND FOR THE INVENTION

In the processing of hazardous and non-hazardous wastes, such as drilling muds, ship bilge, soils contaminated by oil leaks or spills, tank bottoms, municipal solid wastes and the like, it has been a common practice to simply store the materials in, for example, land fills, lagoons and tanks. It has been long appreciated, however, that such methods of dealing with these materials are unsatisfactory for numerous and self-evident reasons. As a result of this appreciation, many industries have devoted significant time and effort to conducting research for alternative industrial processes that avoid creating the waste materials in the first place, or that limit the production of the waste materials. However, these alternative processes add significantly to the cost of the industrial process, making the overall process less profitable.

As an example, in the extraction of oil and gas from wells, there has been an increase in the use of various polymers, rather than chrome laden sulfonate additives, as widely used in the past. The polymers are more expensive and less effective. Nevertheless, the redeeming value in using these polymers is their ability to be effectively destroyed by incineration. In contrast, chrome-based muds, a known hazardous waste resulting from drilling operations that use chrome additives, when incinerated, not only produce harmful by-products during incineration, such as dioxin and nitrous oxide, but also produce a solid residue that is known to be toxic and to contain leachable metals. Hence, it has been found that destructive procedures for dealing with hazardous waste, such as incineration, are generally expensive and often involve byproducts that, in some circumstances, are as harmful as, or more harmful than, the original wastes.

In another example, materials from tank bottoms, bilge bottoms, and oil-contaminated earth are often incinerated. The incineration process is inherently expensive, because most of these wastes are essentially water. Thus, the wastes must not only be boiled, but also be raised to a proper incineration temperature (1800° F. to 2000° F.) and be held at that temperature for one to two seconds to insure nearly complete combustion. Such a procedure is expensive because additional energy is required to reach the proper temperature. Moreover, it is prone to produce further undesirable by-products as discussed hereinabove, but it also destroys (through oxidation) hydrocarbons that would otherwise be of commercial value if recovered.

Furthermore, disposing of drilling muds is difficult, particularly with known mass volume wet oxidation or even super-critical wet oxidation techniques now being used due, at least in part, to the presence and concentration of metal salts, often in excess of 5000 mg/l. It is well known that these metal salts attack the metal containment vessels used in these techniques and severely damage or destroy the metal containment apparatus of those wet chemistry vessels.

It is also a problem that many wastes are at isolated locations and/or exist in too small quantities to economically warrant a typical fixed base incineration process. As a result, these wastes must be transported at great risk and cost.

There are known processing devices that heat wastes in the absence of oxygen to bake away the hydrocarbons from the water and solids residue, but these devices generally utilize either (1) a batch process or (2) a continuous operation process that provides ineffective methodology or apparatus for the recovery of heat energy. The use of heat energy in the operation is required if the processing device is to be efficiently self sustaining. Such ineffective devices are currently used in the extraction of hydrocarbons from tar sands and oil shales. While these are not wastes per se, their processing is similar in nature to hazardous waste processing except that when compared to most hazardous waste, the sand and shale are usually lower in water and hydrocarbon content percentage to the total solid weight of the materials and the recovery of the hydrocarbon is the primary object of the process.

For example, U.S. Pat. No. 4,280,279 discloses a rotating kiln which introduces feed to an inner drum, wherein outgoing solids pass in counterflow in an exterior, concentric drum. Steam and gases are extracted and condensed separately. This, however, violates the principles of conservation of heat energy in that the coldest materials to be treated are on the interior of the device and the exiting solids, which have the highest temperatures, lose most of their heat to the outside walls of the kiln. No heat energy of the water is conserved at all, nor is the heat energy of the oil extracted. The heat necessary to supply the kiln is derived partially from the combustion of the product itself within the kiln supplemented by a burner discharging into the kiln.

Similarly, U.S. Pat. No. 4,285,773 discloses a cold feed into the interior of a rotating kiln and direct firing within the kiln chamber with extraction of the liquid and oil factions, resulting in the loss of heat therefrom, as well as loss of most of the heat from the solid faction due to its outboard placement.

U.S. Pat. Nos. 4,563,246, 4,583,468 and 4,724,777 all disclose retort devices, which lack the ability of using the heat of vaporization of the liquid water and oil factions to preheat incoming materials. Further, all use peripheral spiral chambers for return flow of solids that are known to often result in flow plugging and poor mixing of the exiting solids as necessary for proper heat extraction.

Therefore, a need exists for a retort apparatus for the baking of a liquid and solid mixture, such as for the processing of hazardous waste, sand tar, oil shale or the like, which has the ability to recover and recycle heat energy, useful by-products, and decontaminated materials from the retort process.

SUMMARY OF THE INVENTION

It will, therefore, be appreciated that one aspect of one or more embodiments of the present invention may be to provide a retort apparatus for the baking of liquid and solid mixtures that has a higher thermal efficiency than conventional retort apparatuses. To provide this higher thermal efficiency, in one or more embodiments, the retort apparatus may use the materials entering the apparatus to cool those materials exiting the apparatus. Conversely, in one or more embodiments, the materials entering retort apparatus may be preheated by the materials exiting the apparatus.

One or more other aspects of the invention may be provided by one or more embodiments of a retort apparatus that can recover hydrocarbons impregnated in a liquid and solids mixture, while maintain the high thermal efficiency described above. In one or more embodiments, the recovered hydrocarbons may be used as fuel to provide or augment the fuel needs of the process.

In one or more embodiments, another aspect of the present invention may be achieved by providing a retort apparatus that is capable of recovering liquid produced by the combustion of fuel in the process. In one or more other embodiments, useful by-products and useful decontaminated materials from the retort may be recovered.

In yet one or more other embodiments, an aspect of the invention may be provided by a retort apparatus, that is capable of supplying at least a portion of its own energy needs to facilitate making the apparatus mobile while still retaining its efficiency.

It is a still further aspect of the present invention to provide a method for the processing of liquid and solid mixtures to extract the liquid from the solid.

One or more of these aspects of the present invention, which will become apparent from the description to follow, are accomplished by the improvements hereinafter described and claimed.

In general, the present invention provides a retort apparatus for baking liquid and solid mixtures with the release of gases or vaporized liquids, and extracting and recycling heat energy from waste materials separated therein, includes a plurality of concentrically nested pipes, each pipe having a first end and a second end, an inner and an outer surface, and a substantially common longitudinal axis. The nested pipes include a first rotating pipe within a second rotating pipe which is positioned within a fixed pipe. The first and second rotating pipes are independently rotatable, in both speed and direction, about the substantially common longitudinal axis. An interior area of the first rotating pipe is bounded by the inner surface thereof. A first annulus is formed between the first and second rotating pipes, and a second annulus is formed between the second rotating pipe and the fixed pipe. A heating device or heater is positioned proximate the second end of the first rotating pipe and within the interior area thereof. A gate is provided for introducing the liquid and solid mixture into the first annulus proximate the first end of the second rotating pipe. A first conveyance is provided to move the liquid and solid mixture within the first annulus in a direction toward the second end of the first rotating pipe. A second conveyance is provided for transferring the liquid and solid mixture from the first annulus to the interior area of the first rotating pipe. A third conveyance is provided to move the liquid and solid mixture within the interior area of the first rotating pipe in a direction toward the first end of the first rotating pipe.

There is also provided according to the invention a method of retorting a liquid and solid mixture with the release of gases or vaporized liquids and extracting and recycling heat energy from materials separated therein, which includes the steps of introducing the liquid and solid mixture into the first annulus proximate the second end of the second rotating pipe, causing the liquid and solid mixture to move within the first annulus in a direction toward the first end of the first rotating pipe, and transferring the liquid and solid mixture from the first annulus to the interior area of the first rotating pipe. The method also includes the steps of causing the liquid and solid mixture within the interior area of the first rotating pipe to move in a direction toward the second end of the first rotating pipe.

PREFERRED EMBODIMENT FOR CARRYING OUT THE INVENTION

Figure 1:
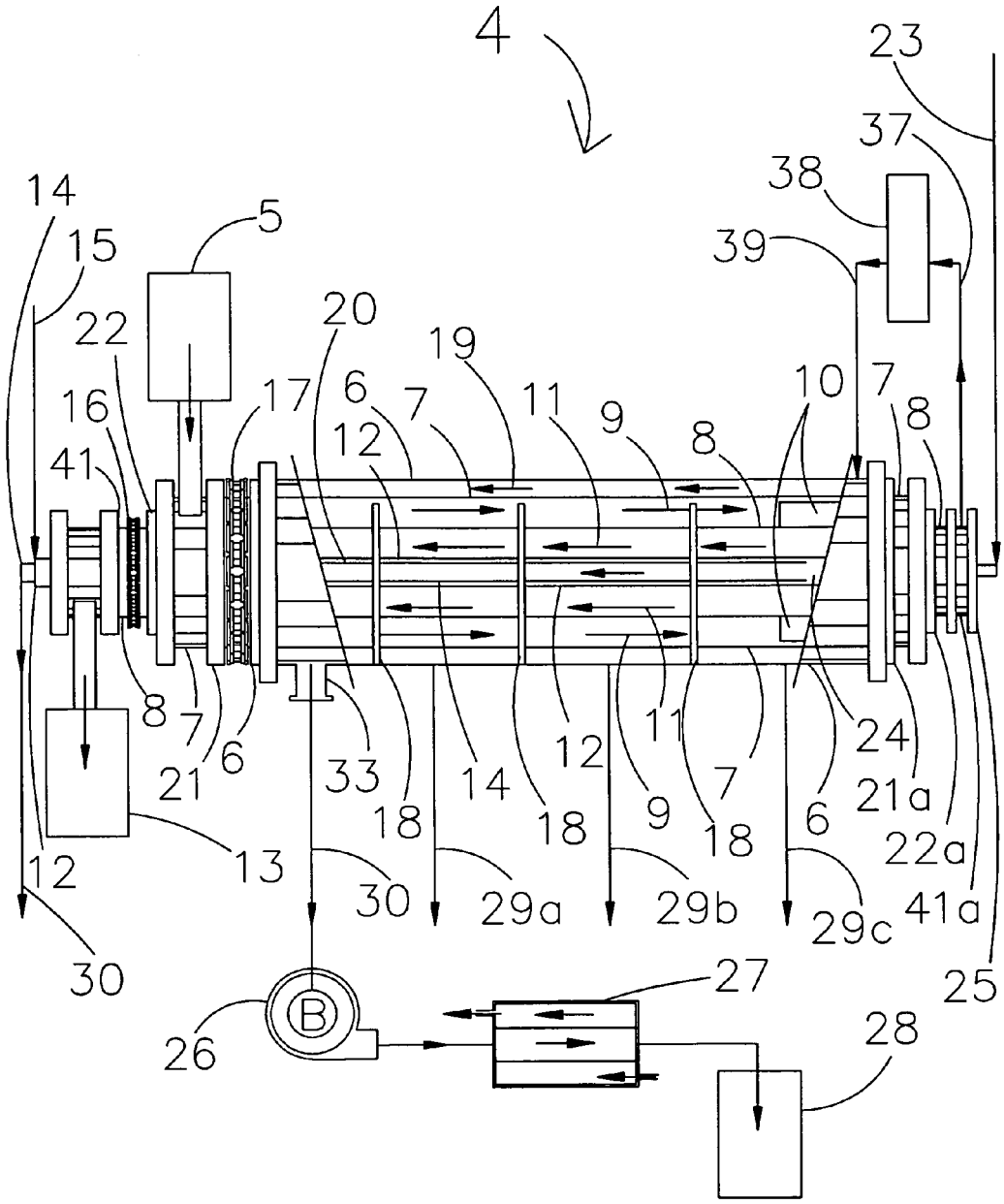
FIG. 1 is a schematic representation of a retort apparatus according to the present invention.

One schematic representative form of a retort according to the concepts of the present invention is generally indicated by the numeral 4 in FIG. 1. The retort apparatus 4 is commonly used for baking a liquid and solid mixture so as to separate the liquid components from the solid components. By the term "baking," it is meant that the liquid and solid mixture is heated in the absence of oxygen. As discussed hereinabove, the liquid constituent or constituents may be any of a variety of materials including, without limitation, water, oil, organic liquids, mixtures thereof and the like. Furthermore, the solid constituent or constituents may include organic matter, inorganic matter, sand, shale, oil shale, tar sands, metals, mixtures thereof and the like. As will be appreciated by one skilled in the art, and as more fully discussed herein below, the baking of these mixtures will result in the release of gases and/or vaporized liquids. The present invention conserves the overall energy of the process employing retort 4, by recovering and recycling energy and recoverable liquids from the solids, the liquids, and from the gases and vaporized liquids.

In at least one embodiment, retort 4 includes a plurality of concentrically nested pipes. As shown in various Figures, the nested pipes may include a primary rotating pipe 8, disposed within a second rotating pipe 7, which, in turn, is further positioned within a containment casing pipe 6. Of course, the number of actual pipes employed is not a limitation of the present invention, and any plurality of pipes that will carry out the objects of the invention as discussed herein are within the scope of the invention.

In one embodiment, pipes 8, 7, and 6 are concentrically nested such that the longitudinal axis of each pipe is substantially the same. It will be understood by those skilled in the art that pipes 8, 7, and 6 may be positioned such that each pipe has the exact same longitudinal axis or positioned such that each pipe has an offset longitudinal axis from the others. All such configurations are considered to be within the scope of the present invention, and are all considered to be encompassed by language such as "substantially the same longitudinal axis" and "substantially common longitudinal axis" or the like. For the ease of this disclosure and for exemplary purposes only, the following discussion and the drawings attached hereto, represent pipes 8, 7, and 6 as having exactly the same longitudinal axis.

The primary rotating pipe 8 and second rotating pipe 7 are independently rotatable about substantially the same longitudinal axis. In one embodiment, pipe 8 may match speed and rotation with pipe 7. In one or more other embodiments, pipe 8 may move in the opposite direction of, or at a speed that is greater than or less than the speed of pipe 7, as may be prudent for cleaning and mixing of the materials to be processed. As shown in FIG. 1, primary rotating pipe 8 has first end 41 and second end 41*a;* second rotating pipe 7 has a first end 22 and a second end 22*a;* and containment casing pipe 6 has a first end 21 and a second end 21*a.* While no two of the pipes 8, 7, and 6 need necessarily be the same length, it will be appreciated that each first end of each pipe will be generally proximate to the first end of every other pipe employed. Likewise, the second ends of each pipe are also generally proximate to the second end of every other pipe in the retort apparatus 4. Reference herein to first ends 21, 22, 41 and second ends 21*a,* 22*a* and 41*a* therefore, is a relative reference based upon the laterally transverse nature of the pipes and is not a limitation of the invention. In one embodiment, primary rotating pipe 7 may be rotated in one direction using a known means for rotating the pipe, such as chain 17. Similarly, in the embodiment, second rotating pipe 8 may be rotated in the same or opposite direction with any like or different means for rotation, including chain 16.

Figure 2A:
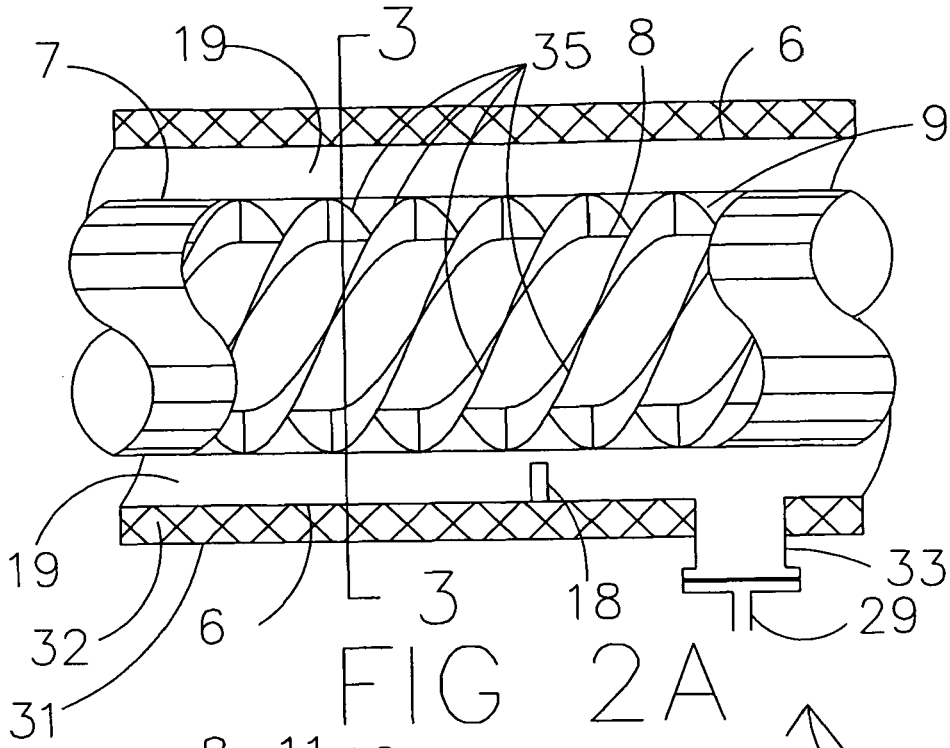
FIG. 2A is a somewhat schematic, partially broken away, partially sectioned elevational view of one portion of the retort apparatus embodying the concepts of the present invention, wherein a series of screw paddle flights are disposed within an annulus between a second rotating pipe and a primary rotating pipe of the retort apparatus.
Figure 2B:
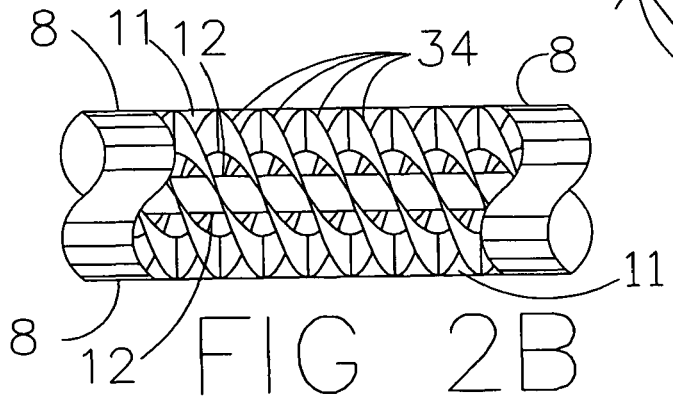
FIG. 2B is a somewhat schematic, partially broken away, partially sectioned elevational view of one portion of the retort apparatus embodying the concepts of the present invention, wherein a series of screw paddle flights are disposed within a different annulus between the primary rotating pipe and a fixed heating tube or pipe of the retort apparatus.

Each pipe 8, 7, and 6 has an inner and an outer surface. As best shown in FIGS. 2A and 2B, the primary rotating pipe 8 in concert with and relative to rotating pipe 7 defines an annulus 9 therebetween. Similarly, the primary rotating pipe 8 in concert with and relative to the fixed heating pipe 12 defines an annulus space 11 therebetween. Further, the second rotating pipe 7, acting in concert with and relative to containment casing pipe 6, defines an annulus space 19 therebetween. It will be appreciated that fixed containment casing pipe 6 may include an outer surface 31 and be relatively thicker than the other pipes in order to provide insulation, such as insulation 32, to the retort apparatus 4.

As best illustrated in FIG. 1, materials to be processed may enter the process at sealed rotating gate 5. These materials, typically liquid and solid mixtures, are then advanced through annulus 9 from the cold end of the retort apparatus 4 to the hot end. That is, in one embodiment, the materials pass through annulus 9 from the first ends 22, 41 of pipes 7, 8 to the second ends 22*a,* 41*a* of the pipes. As the materials advance in annulus 9, they are preheated by fluids and gases on the outside of pipe 7, disposed in annulus 19, as well as from the transfer of heat through pipe 8 from the materials that have already been heated and disposed in annulus 11. It will be appreciated that the materials in annulus 11 are simultaneously being cooled in counterflow by the materials advancing in annulus 9. Materials with the heat recovered therefrom, namely the materials advancing through annulus 11, exit the process at sealed rotating gate 13. Materials that have been preheated in annulus 9 are transferred by the rotating hoppers 10 into the interior annulus 11 at the heating chamber end of annulus 11, proximate the second end of the pipes. Further heat may be provided by a heating tube 14 located within fixed heating pipe 12, which pipe may enclose a steam heat source or a combustion chamber, either of which would be serviced by feed 23 through a thermal control apparatus, such as a combustion heater 24, and passing through seals 25 to the heating tube 14 within the fixed heating pipe 12. It will be appreciated that essentially any means for heating may be used short of processed materials combustion. Examples of other potential heating means may include, but are not necessarily limited to, microwave or radiant electric heat.

With further reference to FIG. 1, any gasses or fluids within heating tube 14 still containing some heat may exit the heating tube 14 through outlet feed 30 and may be extracted. At the same time, combustion air may enter the heating pipe 12 via inlet feed 15, wherein the air may be preheated before reaching the combustion heater 24. Combustion air may advance through an annulus 20 between heating pipe 12 and heating tube 14 until it reaches the combustion heater 24, wherein it is then used or heated and transferred back through the heating tube 14. It will be appreciated that inlet feed 15 and outlet feed 30 may be in heat exchange counter-flow with each other to maintain further conservation of heat energy.

In one embodiment, some treated gasses or fluids may be extracted and collected from the combustion heater 24 and delivered by conduit 37 for use as at treatment container 38 which may be configured to extract and separate, by divergent condensing temperatures or other means, a multiplicity of fluids. The remainder heated fluids and gasses may then be redistributed back to the retort apparatus 4 via conduit 39, where they reenter, between pipe 6 and pipe 7, into annulus 19. Furthermore, the fluids in annulus 19 then move in counter-flow direction to the materials in annulus 9. Again, there fluids aid in pre-heating the materials travelling through annulus 9. Of course, by transferring the heat in these fluids and gasses in annulus 19 to the materials in annulus 9, the fluids and gasses will condense. Baffles 18 divide the containment casing pipe into separate zones of differing temperatures, with the hottest zones proximate to the hot end of the pipes and the coolest zones distal to the hot end of the pipes. Any condensed fluids or liquids cooled below the dew point of targeted heat recovery gasses may exit the device 4 as at outlet 33 for further recovery and use through conduit 30. One or more other conduits, such as conduits 29*a,* 29*b,* and 29*c,* (and there respective outlets) may exist for extracting condensate from the general temperature of that zone of extraction between baffles 18. Any one or more of these conduits, like conduit 30, may carry non-condensed gases to a blower 26. Blower 26 then transfers the gases to a heat exchanger 27, wherein the gases are turned to liquids and received in container 28.

In FIG. 2A, a more detailed schematic, partially in cross-section, of a portion of the retort apparatus generally designated by the numeral 30 in FIG. 2A, is shown. Here, the primary rotating pipe 8 and second rotating pipe 7 clearly define the annulus 9 between them. Within annulus 9 and fixed to the exterior of pipe 8 are a series of nested screw paddle flights 35. The paddle flights 35 may be of equal spacing and at a pitch or angle suitable for conveying the fluids or gasses through the annulus 9 toward the direction of the hot end of the pipes.

In FIG. 2B, a more detailed schematic within the primary rotating pipe 8 of the retort apparatus 4 is shown wherein the primary rotating pipe 8 and fixed heating pipe 12 define the interior annulus 11. Within annulus 11 and fixed to the inside of pipe 8 are a series of nested screw paddle flights 34 that are similar to paddle flights 35. Screw paddle flights 34 may be of equal spacing and of opposite pitch to the nested screw paddle flights 35. Therefore, the paddle flights 34 are also suitable for conveying the fluids and gasses through the annulus 11 toward the direction of the cold end of the pipes. As more particularly seen in the combined series of paddle flights within annuluses 9 and 11 as shown in FIG. 2C, each paddle flight 34 and 35 communicates with its opposite counterpart at loci, shown as 36, that occur at regular intervals, e.g., quarter points, around the circumference of pipe 8 in FIG. 2.

Figure 2C:
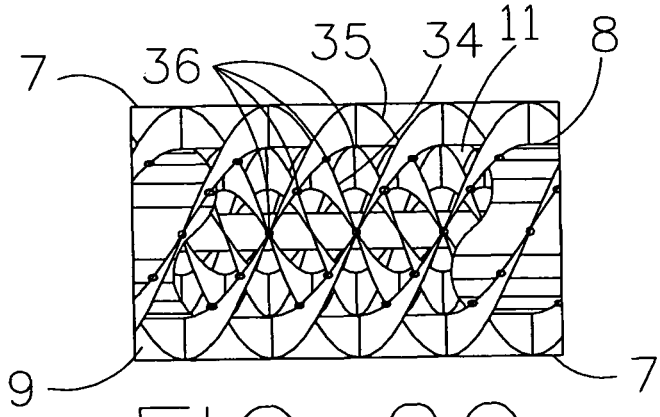
FIG. 2C is a somewhat schematic, partially sectioned elevational view of the portion of the retort apparatus combining the screw paddle flights shown in both FIGS. 2A and 2B.

As can be interpreted from FIGS. 2A-2C, as the upper half of pipe 8 rotates in the clockwise direction when viewing the pipes from a left to right cross sectional view, the materials in annulus 9 are advanced to the right, or toward the heated end, or second end, of the pipes. Due to the opposite pitch of the paddles in annulus 11, the same rotation of pipe 8 advances materials in annulus 11 to the left or away from the heated end, i.e., toward the first end of the pipes. The paddles may include a heat transmitting core alloy that assists in transferring heat from the treated materials exiting the hoppers 10 through annulus 11 to preheat materials being directed to the hoppers 10 through annulus 9.

Figure 3:
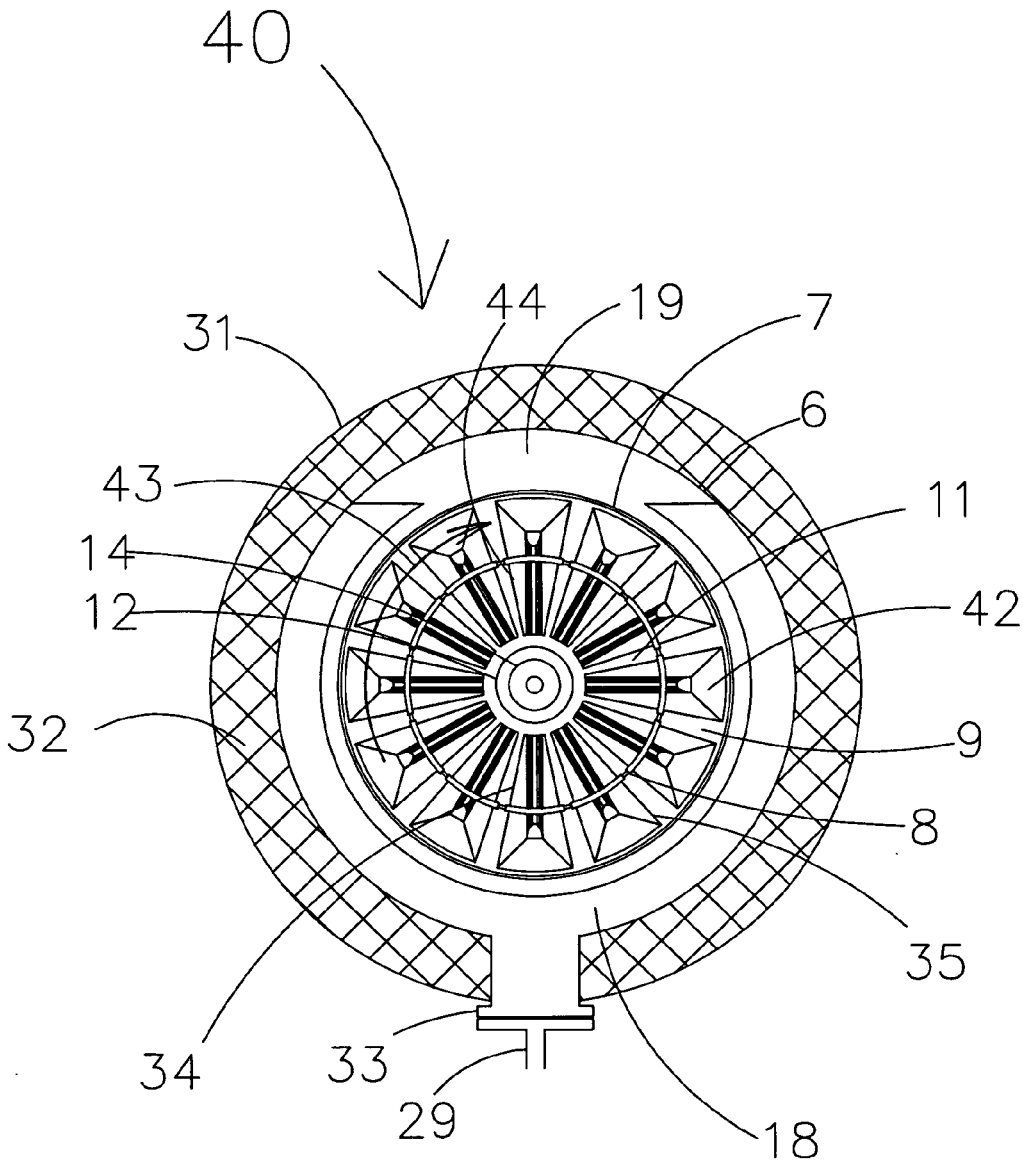
FIG. 3 is a sectional view taken substantially along line 3-3 of FIG. 2A.

In FIG. 3, a cross-section of the retort apparatus is illustrated in FIG. 3 and generally designated by the numeral 40. The section is taken from the section line shown as 3-3 in FIG. 2. While the exact nature of the mechanism to move the liquid and solid mixture within first annulus 9 is unimportant to the overall invention, one preferred mechanism is a first helix or screw conveyance. The paddles flights 34 and 35 are comprised of paddles 42 and 44 that are directly attached to each other and the pipe 8. In that way, the paddle flights 34 and 35 move at the speed of rotation of the pipe 8. Paddle flights 35 are not attached to pipe 7 which pipe is deliberately independent in its motion from pipe 8 and the paddles 35 in order to facilitate cleaning as may be necessary. The rotation of pipe 8 is illustrated by rotation arrow 43 in a clockwise direction, but it is to be understood that the pitch of the paddles and the rotational direction of 8 and the pitch and number of intersecting loci 36 of FIG. 2, can be engineered as desired and the direction of rotation herein is simply for the convenience of presentation. By being spaced, paddles 34, and 35 operate so as to enhance mixing of the materials being conveyed and improve the conveyance of heat into or away from the materials.

Figure 4:
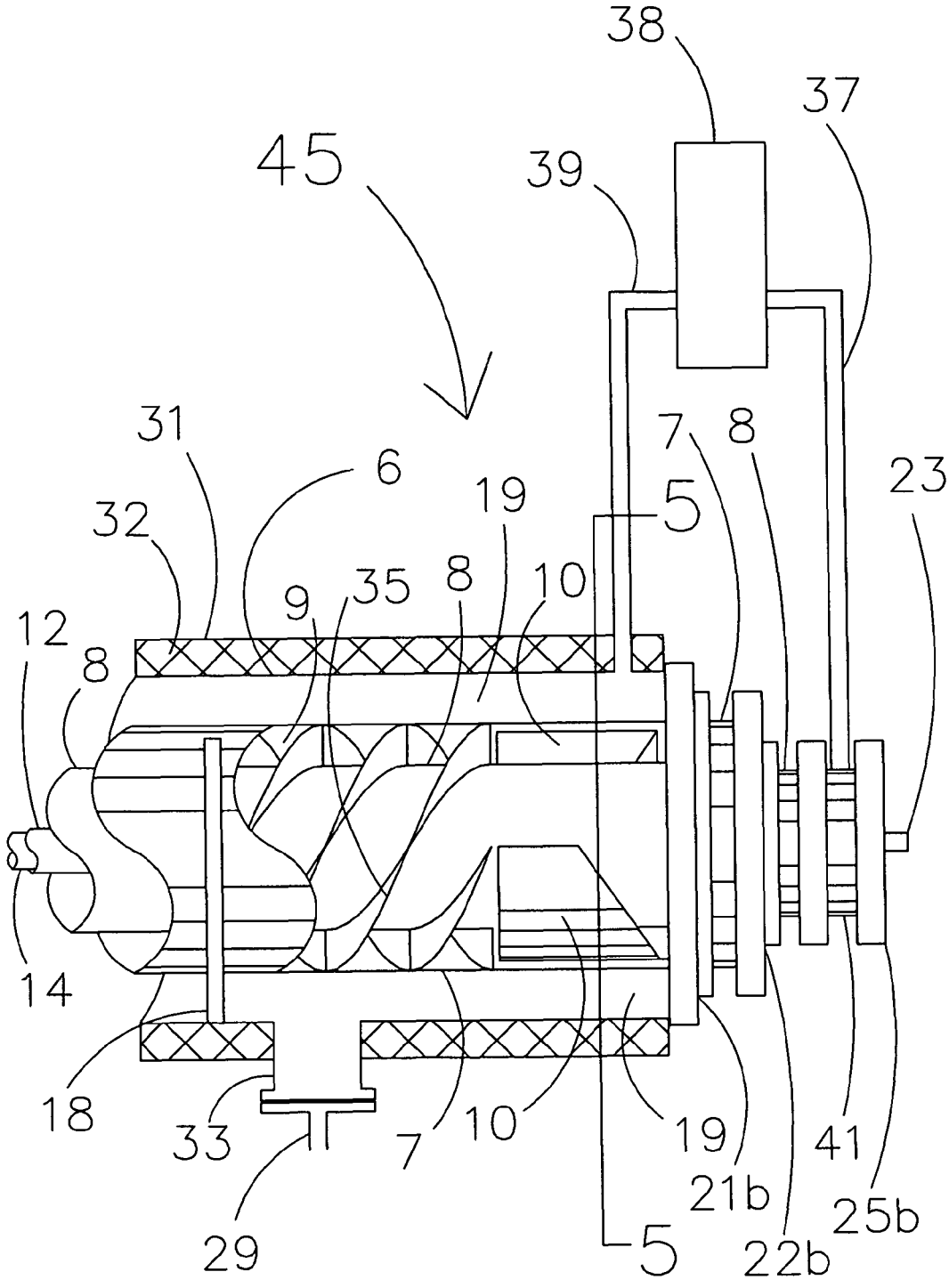
FIG. 4 is a somewhat schematic, partially broken away, partially sectioned elevational view of the hot end portion of the retort apparatus embodying the concepts of the present invention, and showing the burner chamber thereof.

In FIG. 4, a view of the heating end of the devise is illustrated and generally designated by the numeral 45. In this figure, the second rotating pipe 7, acting in concert with and relative to pipe 6, clearly defines an annulus space 19. The location and function of seals 21*b*, 22*b*, and 25*b* are further indicated. Fixed containment casing pipe 6 is more particularly shown to have a thickness of insulation 32 disposed radially inward of the outer surface 31 of the pipe 6. The extraction of treated gasses for further treatment thereof is shown by the use of conduit or other communication means 37 extracting the treated fluids from the hot end of the primary rotating pipe 8 and conveying them to the treatment container 38. The re-admission of extracted gasses via a conduit or other communication means 39 to annulus 19 for heat recovery is also shown. In one embodiment, the annulus 19 may be baffled as at baffle 18 to assist and enable the counter-flow of heat energy with respect to the direction of travel of materials in annulus 19. Rotating hoppers 10 may be equipped with canted ribs (not shown) to assist in transferring materials from annulus 9 into annulus 11.

Figure 5:
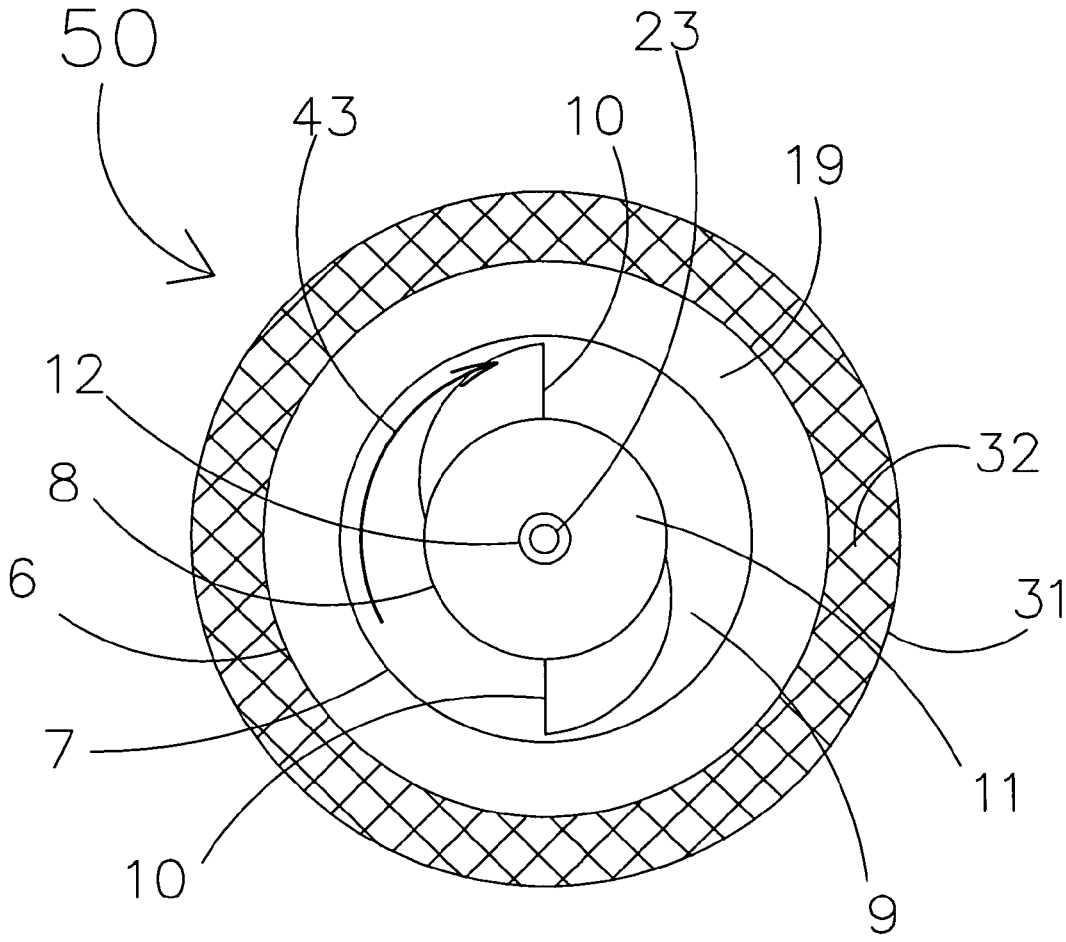
FIG. 5 is a sectional view taken substantially along lines 5-5 in FIG. 4.

A sectional end view of the heating chamber is more particularly shown in FIG. 5 and is generally designated as the numeral 50. The section is taken from section line 5-5 in FIG. 4. This end view helps to illustrate the nature of the hoppers 10. The rotational direction in this example is again shown by rotation arrow 43 in the clockwise direction as this figure is viewed looking toward the heated ends of the pipes. Hoppers 10 are attached to pipe 8 and, hence, rotate at the same speed as the rotation of pipe 8. Like the paddle flights 35, the hoppers are not connected to pipe 7, allowing for easy of cleaning. A plurality of ribs (not shown) may be employed in hoppers 10 to preclude jamming, or to impose a directional bias to the flow of materials from annulus 9 to annulus 11. The second rotating pipe 7 in concert with pipe 6 defines an annulus space 19. Generally, the materials to be treated are collected into the hoppers at the end of annulus 9. The materials eventually fall out of the hoppers 10 and flow into annulus 11.

Figure 6:
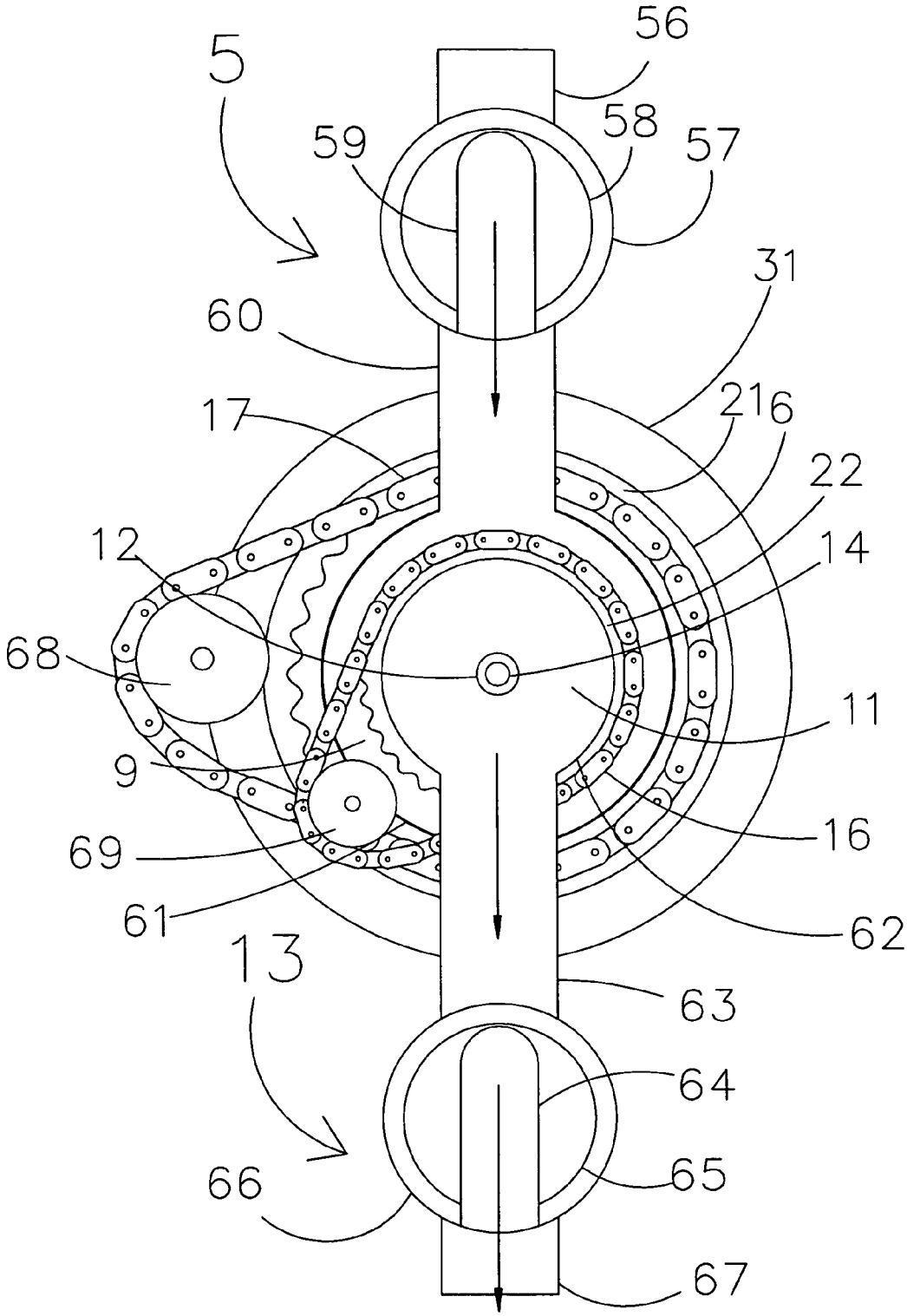
FIG. 6 is an end view of the apparatus depicted in FIG. 4, taken from the entrance or cold end of the apparatus opposite the burner chamber shown in FIG. 4.

FIG. 6 is an end elevational view of the feed and exit end of the retort apparatus 4, and is generally indicated as 55 in FIG. 6. One type of means for rotating pipes 7 and 8 are shown in this figure. Here, in this embodiment, rotation of the second rotating pipe 7 occurs by the forced rotation of the pipe by chain 17. A chain drive 68 operates by any means known in the art to manipulate the chain 17 and rotate pipe 7. Similarly, in this embodiment, rotation of the primary rotating pipe 8 occurs by the forced rotation of the pipe by chain 16. A chain drive 69 operates by any means known in the art to manipulate the chain 16 and rotate pipe 8.

In one embodiment, materials may enter a hopper (not shown) and travel to rotary valve 57 via conduit 56. When the rotary valve 57 is turned so that the seal surface 58 allows the charging chamber 59 to be open at the top, and materials can enter the gate 5. Once the rotary gate valve 57 is opened and has received the mixture to be processed, the valve 57 may then be turned through seal 58 so that the charging chamber 59 is opened to the annulus 9 via conduit 60 as shown in the illustrated position of FIG. 6. In the embodiment shown, charging is done in batch fashion. However, it is frequent enough to allow a sealed continuous stream of materials to be admitted to the device while isolating the atmosphere from intruding into the process and maintaining the integrity of the generated gasses emerging from the materials to be processed. The materials to be processed then enter annulus 9 as defined by wall 61.

In like manner, to dispense with processed materials, the processed materials may enter a conduit 63 from annulus 11, as defined by wall 62. When the rotary valve 66 is turned through seal surface 65 so that the charging chamber 64 coincides with the conduit 63, the flow is opened to materials, and materials enter the sealed rotary gate 13. Then, once the gate is full, the rotary gate valve 66 may then be turned through seal 65 so that the charging chamber 64 is open to a discharge position as shown in the illustrated position of FIG. 6 and so that the processed materials can pass along through conduit 67 to another hopper or the like.

One skilled in the art will appreciate that the bounds of the heating zone will vary with the heat output of a heater source, as well as with other process conditions. Furthermore, a retort having multiple heater units and hence, multiple heating zones, is within the scope of the invention. For simplicity and for exemplary purposes, the present invention will be described herein as having a singular combustion heater 24 and hence, a singular heating zone.

As the liquid and solid mixture enters the heating zone, the heat from heater 24 in fixed heating tube 14 of FIG. 1, causes the liquid and solid mixture to bake, with the result that some or perhaps all of the liquids, such as water or the like, are caused to vaporize, and various gases may be given off. The amount of this separation may be controlled by the temperature of heating tube 14 as well as the speed with which the liquid and solid mixture is caused, to move through the annuli. These factors will vary depending upon the application with which the invention is utilized, as will be appreciated by one skilled in the art. Hence, temperature and speeds are not an absolute limitation of the invention. Different temperatures, speeds and other conditions will vary depending upon the mixture to be processed and the desired result of the process, for example, oxidation or pyrolysis of the materials, recovery of hydrocarbons, soil, and the like.

In operation, it will be appreciated that heat energy transferred from components and materials within the interior annulus 11 containing the highest temperature liquid and solid mixture to components and materials in annulus 9 containing generally lower temperature portions of the liquid and solid mixture. Thus, because the higher temperature material is effectively internal of the lower temperature material, heat is not lost as readily to the surrounding environment as with the known prior retort devices. Rather, the heat is transferred to the incoming liquid and solid mixture, effecting an efficient recycle of the heat energy. That is, the incoming liquid and solid mixture is preheated, thus requiring less energy from heating tube 14 to achieve proper baking temperature. However, for even further increased efficiency, if heating tube 14 is of a combustion type, combustible gases from pipe conduit 15, such as various hydrocarbons, released as a result of the baking process discussed hereinabove, may be extracted and used as the fuel for combustion in heating chamber 24 and heating tube 14.

If the retort 4 is employed to remove combustible materials, such as for example, various hydrocarbons, these materials may be removed and stored for further use. It will be appreciated by one skilled in the art that retort 4 is energy self-sufficient to some degree, making it ideally suited, for example, to be transported to the waste material for treating the material, rather than vice versa.

Figure 7:
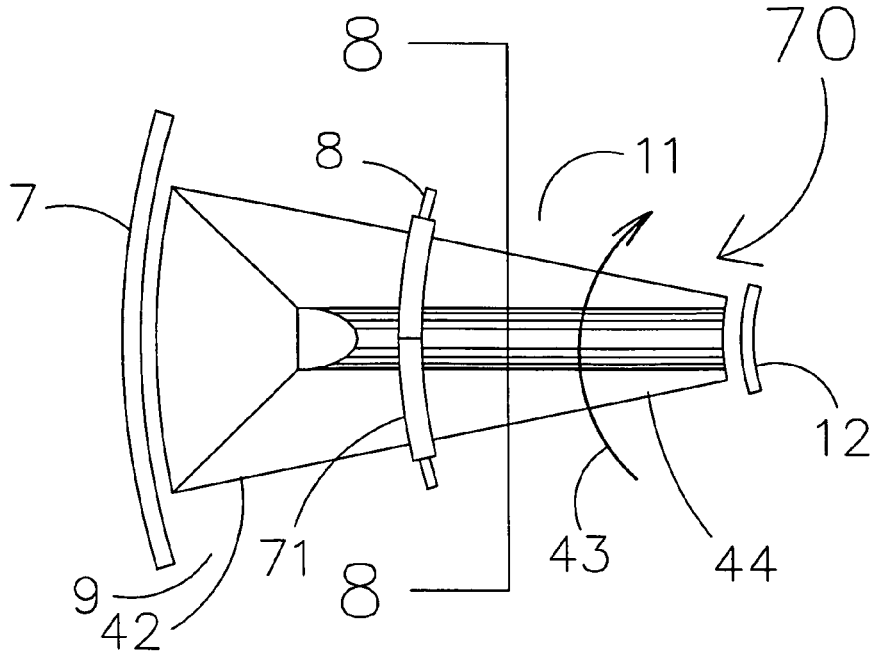
FIG. 7 is an enlarged detailed, elevational view of a paddle from FIG. 3 employed in the apparatus according to the present invention for moving the liquid and solid materials to be processed.
Figure 8:
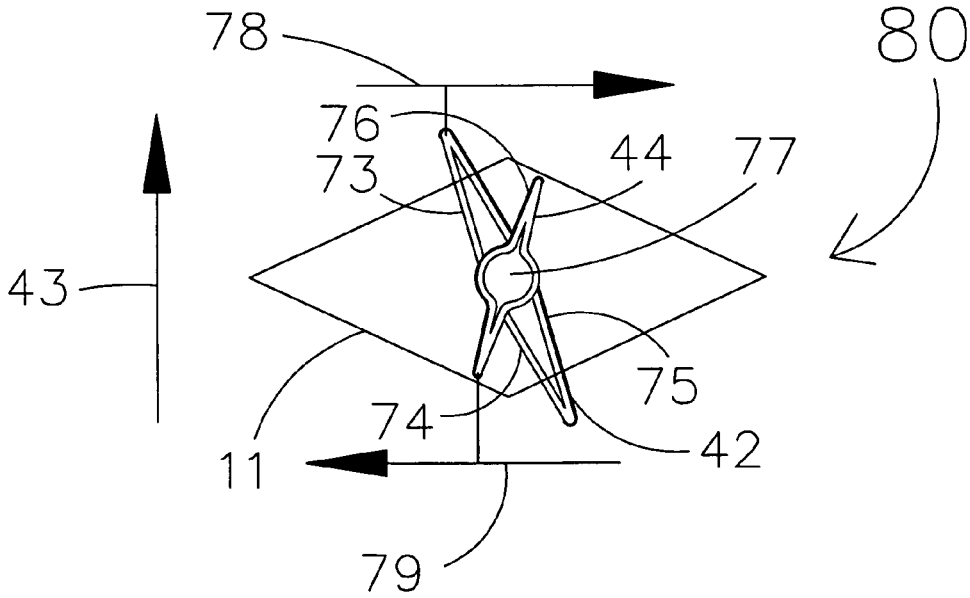
FIG. 8 is an enlarged, sectional view of the paddle apparatus as taken substantially along line 8-8 of FIG. 7.

With reference to FIGS. 7 and 8, one embodiment of interrupted paddles is generally indicated as 70 in FIG. 7. Paddles 42 and 44 of the first and second screw conveyances, respectively, are shown. While paddles 42 and 44 may be of any configuration which will carry out the objects of the invention as discussed herein, it is preferred that the leading surface 75 of paddle 42, and the leading surface 76 of paddle 44, be disposed with a hard surface composition that is resistant to wear, such as an alloy of steel. Further, in one embodiment, the core 77 of paddles 42 and 44 should be of a material conducive to the transmission of heat, such as aluminum. The two metals may be, in turn, contacted and wetted by a interim surface of a materials such as nickel. In another embodiment, at the tip of paddle 42, a protruding tip may be defined to function as a plow point for either direction of movement of paddle 42.

FIG. 8 is a partial elevational view of a repeating section of pipe wall 8 and the associated paddles as seen from the inside of pipe 8 and is generally depicted by the numeral 80. The section is taken along section line 8-8 in FIG. 7. In the depiction, the indicated direction of travel for the mixture is from bottom to top, and it can be seen that paddle 42 will move materials in one direction as shown by arrow 78, and paddle 44 will move materials in the direction indicated by 79. Each paddle 42 and 44 is protected by a covering of an erosive resistant material as at leading surfaces 75 and 76 respectively. The core of the paddles throughout their length is of a heat conductive material as at 77. By first developing these repeating sections, and then joining them in a surface at boundary 71, pipe 8 can be constructed to give preference to the heat transfer and structural integrity of paddles 42 and 44 within pipe wall 8.

Paddles 42, 44 may be made of a laminate construction for strength, such as by providing a base layer of a heat conductive material such as aluminum, supporting a steel layer, and having a nickel interface therebetween. Anti-wear surfaces may also be provided such as those made of Stellite, a chromium-tungsten alloy available from Union Carbide, or Barberite, a suspension of carbide grit in a steel matrix that is usually stainless steel but may employ other metals depending upon the supporting metal, e.g., using a layer of nickel if the base is aluminum with Barberite over the nickel. Such surfaces may be shown as 73 and 74 on paddle 42.

Figure 9:
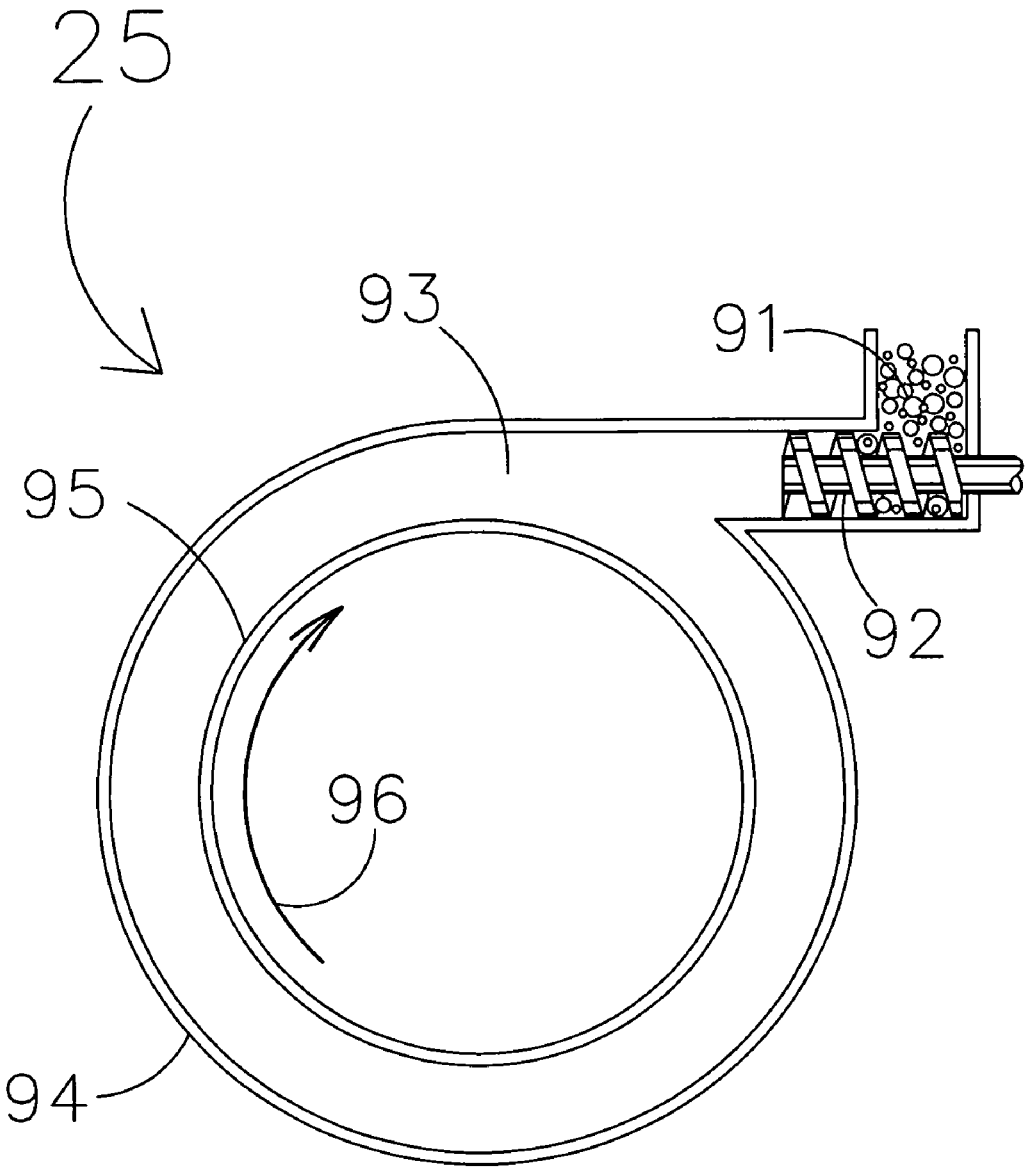
FIG. 9 is a schematic representation of the sustained seal apparatus employed to sustain the integrity of the interface between the concentric nested pipe that rotate with respect to another concentric nested pipe.

In FIG. 9, an elevational sectional view of one embodiment of a seal is shown of the type anticipated to be suitable for the retort 4, and is generally depicted as numeral 25. The nature of the materials handled, the variation from thermal expansion, and the variable rotation directions and speed will likely require a seal that will tend to abate and loose packing. To overcome the potential loss, a soft seal a material such as a fiberglass fiber can be introduced in small open packets as at 91. A slowly operating screw feed 92 can continuously supply replacement fibers and maintain gasket internal pressures to the annulus 93 as defined by the gasket containment walls 94 and 95. As the internal pipe turns as indicated by arrow 96, the heat resistant fiber materials 91 may then be fed into the gasket annulus to sustain the amount of pressure and fiber materials forming said gasket.

To effect rotation of first and second rotating pipes 8 and 7, any conventional technique and apparatus may be employed. For example, one method has been shown above in FIG. 6. Another method would include the following. A motor driven belt (not shown) may be provided which is driven by a motor (not shown) to rotate pipes 8 and 7. Bearings such as ball bearings or rollers (not shown) may be provided to facilitate such rotation, as is conventional in the art for rotating elements. Thus, the means of rotating the pipes 7 and 8 should not be limited by the examples provided herein.

Thus it should be evident that the device and methods of the present invention are highly effective in conserving heat energy in a retort for the processing of liquid and solid mixtures. The invention is particularly suited for processing of hazardous waste sludge, oil shale, and the like, but is necessarily limited thereto. The device and method of the present invention can be used separately with other equipment, methods and the like, as well as for the separation of other materials in addition those exemplified hereinabove. Based upon the foregoing disclosure, it should now be apparent that the use of retort 4 described herein will carry out the objects set forth hereinabove. It is, therefore, to be understood that any variations evident fall within the scope of the claimed invention and thus, the selection of specific utilization of retort 4, its operating conditions and the like, can be determined without departing from the spirit of the invention herein disclosed and described. Thus, the scope of the invention shall include all modifications and variations that may fall within the scope of the attached claims.

What is claimed is:

1. A retort apparatus for baking a liquid and solid mixture with the release of gases or vaporized liquids, and extracting and recycling heat energy and recoverable liquids from materials separated therein, comprising:

a plurality of concentrically nested pipes;

each of said pipes having a first end and a second end, and a substantially common longitudinal axis; said nested pipes including a heated pipe within a primary rotating pipe within a second rotating pipe within a fixed pipe;

said primary and second rotating pipes being rotatable about said substantially common longitudinal axis;

a first annulus formed between said primary and second rotating pipes; a second annulus formed between said heated pipe and said primary rotating annulus; and a third annulus formed between said second rotating pipe and said fixed pipe;

a heater positioned proximate said second end of said first rotating pipe and within an interior area thereof;

a first conveyance to move the liquid and solid mixture within said first annulus in a direction toward said second end of said second rotating pipe, whereby the mixture is pre-heated by acquiring heat energy from the second and third annuli, and wherein said first conveyance includes a first screw conveyance comprising a plurality of spaced paddles affixed to said primary rotating pipe and extending into said first annulus, such that said first screw conveyance rotates with the rotation of said primary rotating pipe;

a second conveyance to transfer the liquid and solid mixture from said first annulus to said second annulus, whereby the liquid and solid mixture is further heated by said heater; and a third conveyance to move the heated liquid and solid mixture within said second annulus in a direction toward said first end of said first rotating pipe, whereby the mixture is cooled by the dissipation of heat energy to the second annulus, and wherein said third conveyance includes a second screw conveyance comprising a plurality of spaced paddles affixed to said primary rotating pipe, such that said second screw conveyance rotates with the rotation of said primary rotating pipe and wherein said paddles of said first screw conveyance are in heat transfer relation with said paddles of said second screw conveyance, such that heat from the liquid and solid mixture moving in said second annulus is caused to be transferred to said first annulus to heat the liquid and solid mixture therein.

2. A retort apparatus as in claim 1, further comprising a gate for introducing the liquid and solid mixture into said first annulus proximate said first end of second rotating pipe.

3. A retort apparatus as in claim 2, further comprising a second gate for extracting the processed, cooled liquid and solid mixture from the second annulus proximate said first end of said primary pipe.

4. A retort apparatus as in claim 1, further comprising a plurality of baffles positioned within said second annulus, such that only noncondensed gases or noncondensed vaporized liquids can pass said baffles.

5. A retort apparatus as in claim 1, further comprising a gas recirculating conduit for conducting heated gases and vaporized liquids from said second annulus proximate said second end of said primary pipe to said third annulus.

6. A retort apparatus as in claim 1, further comprising an outlet for recovering condensed fluids from said third annulus.

7. A retort apparatus as in claim 1, further comprising a heating tube concentrically nested within said heated pipe, wherein a fourth annulus is formed between said heated pipe and said heating tube, and wherein combustion air may be conveyed through said fourth annulus to said heater.

8. A retort apparatus as in claim 1, wherein one of said paddles of said first screw conveyance is integrally formed with a corresponding one of said paddles of said second screw conveyance.

9. A method of retorting a liquid and solid mixture with the release of gases or vaporized liquids and extracting and recycling heat energy and recoverable liquids from materials separated therein, comprising the steps of:

introducing the liquid and solid mixture into an annulus formed between inner and outer rotating pipes;

causing the liquid and solid mixture to move within the annulus in a direction toward one end of the pipes by use of spaced paddles attached to outside of the inner of the rotating pipes;

preheating the liquid and solid mixture within the annulus as the mixture moves, the step of preheating caused by previously heated gases and vaporized fluids within an exterior annulus outside the outer of the rotating pipes and a previously heated liquid and solid mixture with an interior annulus inside the inner of the rotating pipes;

transferring the liquid and solid mixture from the annulus to the interior annulus of the inner of the rotating pipes, the transferred liquid and solid mixture having been heated; and causing the previously heated liquid and solid mixture within said interior annulus of the inner of the rotating pipes to move in a direction toward the other end of the rotating pipes by use of a second set of spaced paddles attached to the inside of the inner of the rotating pipes, such that the spaced paddles and the second set of spaced paddles are in heat transfer relationship to each other.

10. A method as in claim 9, further comprising the step of rotating the inner and the outer rotating pipes in opposite directions about a substantially common longitudinal axis.

11. A method as in claim 9, further comprising the step of transferring gases or vaporized liquids from said interior annulus of the inner rotating pipe to the exterior annulus formed between the outer rotating pipe and a fixed shell.

12. A method as in claim 11, further comprising the step of controlling the temperature within the exterior annulus formed between the outer rotating pipe and the fixed shell by at least partially obstructing the annulus, such that only gases or vaporized liquids having a certain temperature are allowed to pass through the annulus.

13. A method as in claim 9, further comprising the step of circulating cooling material through the annulus to cool the previously heated liquid and solid mixture within said interior annulus of the inner of the rotating pipes.

* * * * *